US010450782B2

(12) United States Patent
Nurmi et al.

(10) Patent No.: US 10,450,782 B2
(45) Date of Patent: Oct. 22, 2019

(54) APPARATUS AND METHOD FOR ENHANCING SOUND PERFORMANCE OF A LATCH

(71) Applicant: INTEVA PRODUCTS, LLC, Troy, MI (US)

(72) Inventors: Kurt E. Nurmi, Macomb, MI (US); Julia Rabago, Chihuahua (MX); Rogelio Terrazas, Chihuahua (MX); Donald M. Perkins, Sterling Heights, MI (US); Carlos Tostado, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 1116 days.

(21) Appl. No.: 14/598,840

(22) Filed: Jan. 16, 2015

(65) Prior Publication Data

US 2015/0204114 A1 Jul. 23, 2015

Related U.S. Application Data

(60) Provisional application No. 61/928,675, filed on Jan. 17, 2014, provisional application No. 61/928,642, filed on Jan. 17, 2014.

(51) Int. Cl.

| | |
|---|---|
| ***E05B 85/26*** | (2014.01) |
| ***E05B 77/38*** | (2014.01) |
| ***E05B 85/02*** | (2014.01) |
| *E05B 17/00* | (2006.01) |
| *E05B 77/36* | (2014.01) |

(52) U.S. Cl.

CPC ..... *E05B 85/02* (2013.01); *E05B 77/38* (2013.01); *E05B 85/26* (2013.01); *E05B 17/0045* (2013.01); *E05B 77/36* (2013.01); *Y10T 292/1043* (2015.04); *Y10T 292/62* (2015.04)

(58) Field of Classification Search

CPC ..... E05B 77/36; E05B 77/38; E05B 17/0045
USPC ..... 292/216, 337
See application file for complete search history.

(56) References Cited

U.S. PATENT DOCUMENTS 3,705,738 A * 12/1972 Yoshimura ..... E05B 85/243 292/216
3,969,789 A 7/1976 Wize
4,586,737 A * 5/1986 Arlauskas ..... E05B 85/243 292/207

(Continued)

FOREIGN PATENT DOCUMENTS

CN 201671445 U 12/2010
CN 102858566 A 1/2013

(Continued)

OTHER PUBLICATIONS

CN Application No. 20151002616038 Office Action; dated Nov. 4, 2016.

(Continued)

*Primary Examiner* — Carlos Lugo
(74) *Attorney, Agent, or Firm* — Cantor Colburn LLP

(57) ABSTRACT

A latch is provided. The latch having: a housing; an intermittent lever pivotally mounted to the housing for movement between a latched position and an unlatched position; and an elastomeric feature configured to contact the intermittent lever when it is in the latched position.

9 Claims, 10 Drawing Sheets

(56) References Cited

U.S. PATENT DOCUMENTS

| | | | | |
|---|---|---|---|---|
| 4,854,617 | A * | 8/1989 | Hayakawa | E05B 77/40 292/216 |
| 5,020,838 | A * | 6/1991 | Fukumoto | E05B 81/14 292/201 |
| 5,106,134 | A * | 4/1992 | Thau | E05B 85/045 292/216 |
| 6,419,286 | B1 * | 7/2002 | Szablewski | E05B 77/24 292/216 |
| 6,568,741 | B1 | 5/2003 | Leung | |
| 6,679,531 | B2 | 1/2004 | Rogers, Jr. et al. | |
| 6,698,805 | B2 * | 3/2004 | Erices | E05B 77/04 292/201 |
| 6,789,825 | B2 * | 9/2004 | Kalargeros | E05B 85/26 292/201 |
| 7,156,430 | B2 * | 1/2007 | Hidding | E05B 85/02 292/216 |
| 7,195,292 | B2 * | 3/2007 | Ketelsen | E05B 85/26 292/201 |
| 7,267,380 | B2 * | 9/2007 | Bullock | E05C 3/24 292/337 |
| 7,454,933 | B1 * | 11/2008 | Paige | E05B 1/0092 292/207 |
| 7,789,440 | B2 * | 9/2010 | Graute | E05B 85/26 292/216 |
| 7,845,692 | B2 * | 12/2010 | Inan | E05B 77/38 292/216 |
| 8,235,428 | B2 * | 8/2012 | Hunt | E05B 85/26 292/216 |
| 8,342,582 | B2 * | 1/2013 | Bendel | E05B 85/02 292/216 |
| 8,348,310 | B2 | 1/2013 | Vazquez et al. | |
| 8,398,128 | B2 * | 3/2013 | Arabia | E05B 77/06 292/1 |
| 8,888,150 | B2 * | 11/2014 | Nagaoka | E05B 77/38 292/340 |
| 9,151,092 | B2 * | 10/2015 | Scholz | E05B 85/26 |
| 9,777,515 | B2 * | 10/2017 | Barmscheidt | E05B 81/06 |
| 2009/0224559 | A1 * | 9/2009 | Park | E05B 85/26 292/336.3 |
| 2010/0127512 | A1 | 5/2010 | Vazquez et al. | |
| 2011/0133493 | A1 | 6/2011 | Perkins et al. | |
| 2011/0204659 | A1 | 8/2011 | Estrada et al. | |
| 2012/0292927 | A1 | 11/2012 | Vazquez et al. | |
| 2014/0292000 | A1 | 10/2014 | Vazquez et al. | |
| 2015/0204115 | A1 * | 7/2015 | Nurmi | E05B 85/26 292/194 |

FOREIGN PATENT DOCUMENTS

| | | | | |
|---|---|---|---|---|
| EP | 995870 | A1 * | 4/2000 | |
| EP | 2626490 | | 8/2013 | |
| GB | 2321928 | A * | 8/1998 | E05B 77/38 |
| JP | 04131484 | A * | 5/1992 | E05B 77/40 |
| JP | 05156854 | A * | 6/1993 | |
| JP | 11182113 | | 7/1999 | |
| JP | 2003113687 | A * | 4/2003 | E05B 85/26 |
| JP | 20070270573 | | 10/2007 | |
| WO | 20100628805 | A3 | 7/2010 | |

OTHER PUBLICATIONS

CN Application No. 201510026399.5 Office Action; dated Dec. 8, 2016.
CN Application No. 201510026399.5 Search Report.
CN Application No. 201520036414.X Office Action; dated May 22, 2015.
English Abstract for CN201671445.
English Abstract for CN102858566.
English Abstract for EP2626490.
English Abstract for JP2007270573.
English Abstract for JPH1182113.
English Machine Translation of Specification and Claims for CN102858566.
English Machine Translation of Specification and Claims for CN201671445.
English Machine Translation of Specification and Claims for EP2626490.
English Machine Translation of Specification and Claims for JP2007270573.
English Machine Translation of Specification and Claims for JPH1182113.
English Translation for CN Application No. 20151002616038 Office Action; dated Nov. 4, 2016.
English Translation for CN Application No. 201510026399.5 Office Action; dated Dec. 8, 2016.

* cited by examiner

APPARATUS AND METHOD FOR ENHANCING SOUND PERFORMANCE OF A LATCH

CROSS REFERENCE TO RELATED APPLICATIONS

This application claims the benefit of U.S. Provisional Patent Application Ser. No. 61/928,675 filed on Jan. 17, 2014, the entire contents of which are incorporated herein by reference thereto.

This application also claims the benefit of U.S. Provisional Patent Application Ser. No. 61/928,642 filed on Jan. 17, 2014, the entire contents of which are incorporated herein by reference thereto.

BACKGROUND

Various embodiments of the present invention relate to a latch and more particularly, a latch with enhanced sound performance.

In some applications, moving components of the latch contact other components which create undesirable operational noises or audible sounds.

Accordingly, it is desirable to provide a latch with improved sound performance.

SUMMARY OF THE INVENTION

In one embodiment, a latch is provided. The latch having: a housing; an intermittent lever pivotally mounted to the housing for movement between a latched position and an unlatched position; and an elastomeric feature configured to contact the intermittent lever when it is in the latched position.

In another embodiment, a housing for a latch is provided, the housing having a strengthening feature.

In yet another embodiment, the strengthening feature is a plurality of ribs.

In yet another embodiment, a latch is provided. The latch having: a housing; an intermittent lever; and an elastomeric feature configured to contact the intermittent lever when it is in the latched position and wherein the housing is configured to have a strengthening feature.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Reference is made to the following U.S. Pat. Nos. 3,969,789; 6,568,741; 6,679,531; 8,348,310 and U.S. Patent Publication Nos. US 2010/0127512; US 2011/0204659; US 2012/0292927 and US 2014/0292000, the entire contents each of which are incorporated herein by reference thereto.

Figure 1:
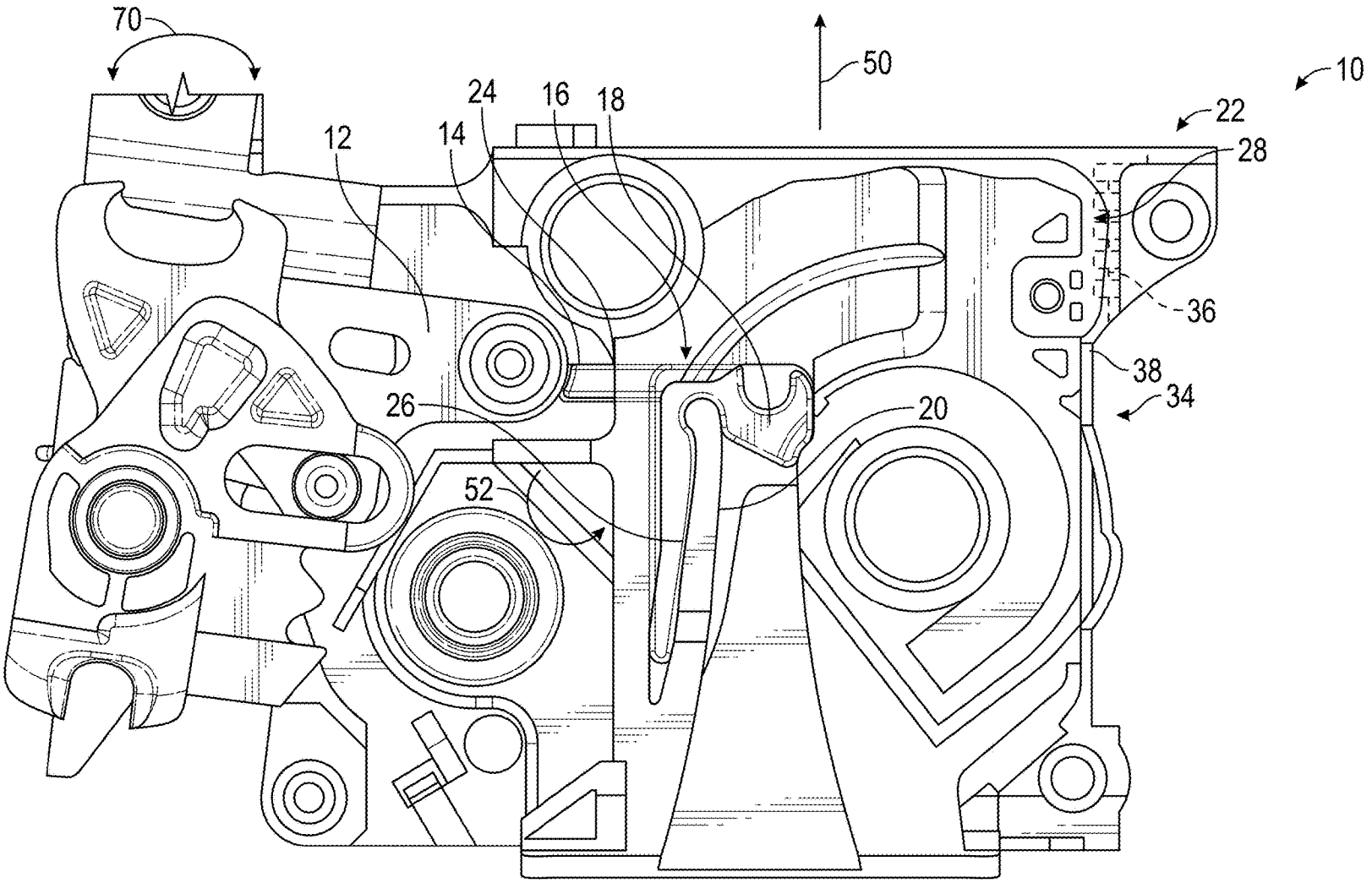
FIG. 1 is a top view of a latch housing wherein the intermittent lever is in the latched position and portions of the latch housing are illustrated in phantom.

Referring now to the FIGS. and in particular, FIG. 1 a latch 10 is illustrated. In one embodiment, the latch 10 is a vehicle door latch or any other vehicle latch or any other type of latch vehicular or otherwise. The housing of the latch 10 may be formed from an easily molded material such a plastic or any suitable polymer. Alternatively, latch housing 10 may be formed from a metal or metal alloy of combinations of metal, metal alloys and plastic.

In order to prevent unwanted noises it is sometimes necessary to encapsulate moving components of the latch with an elastomeric casing however and in some latches there are many moving components and it may not be possible or economically feasible to encapsulate all moving components that are capable of making audible noises when they contact other components of the latch.

Figure 1A:
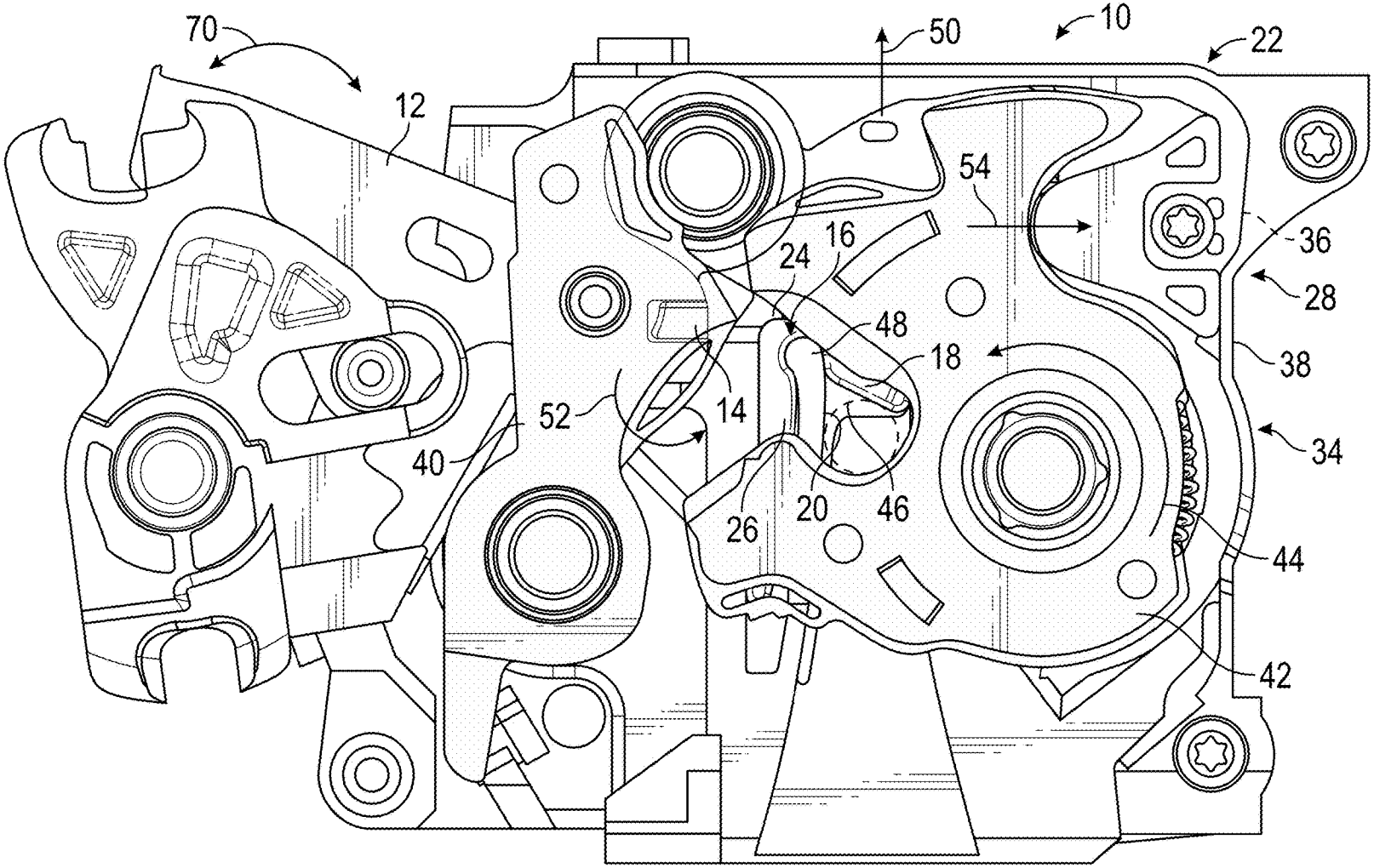
FIG. 1A is a top view of the latch housing wherein the intermittent lever is in the latched position and the fork bolt and the detent lever are illustrated in phantom.
Figure 2:
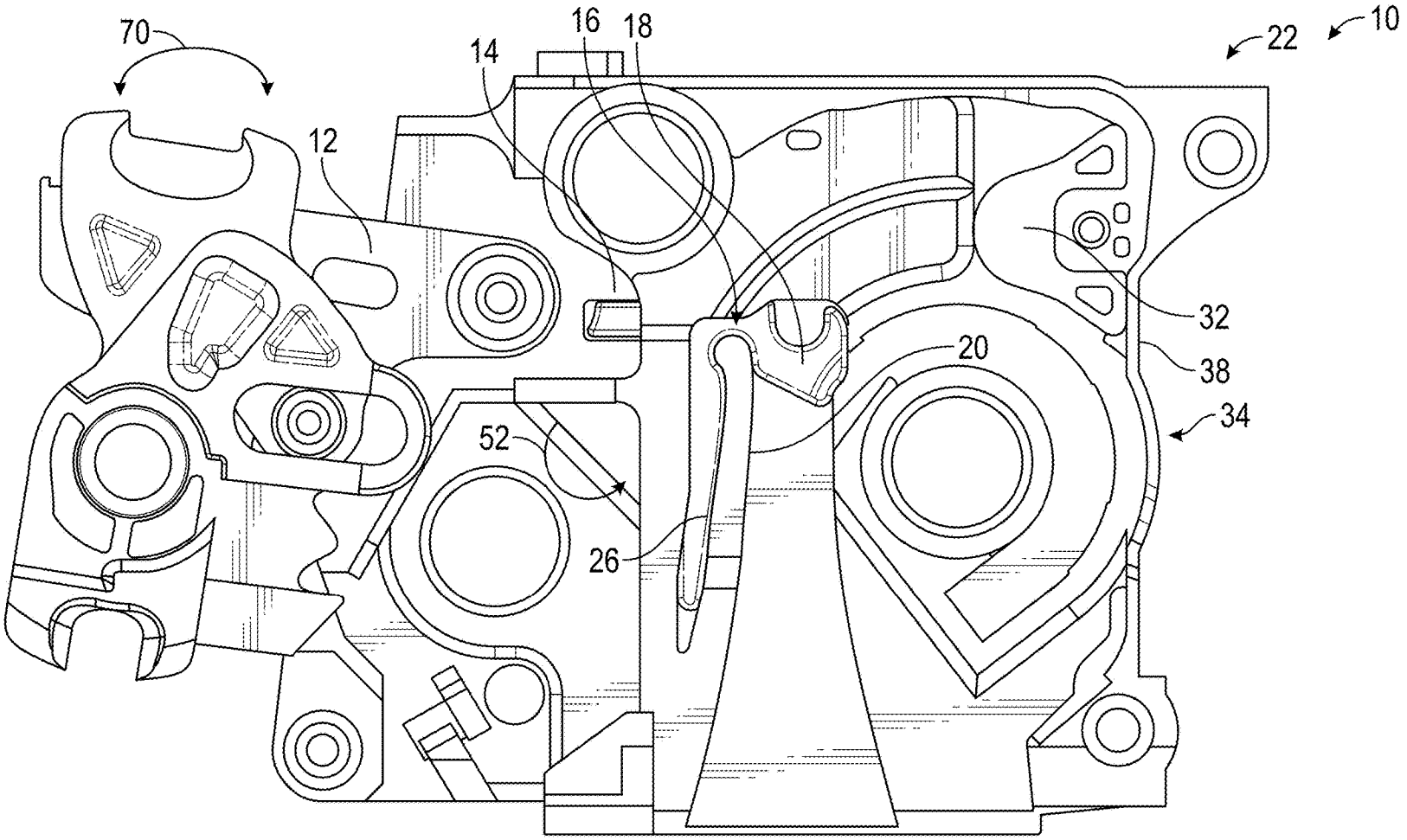
FIG. 2 is a top view of the latch housing wherein the intermittent lever is in an unlatched position and portions of the latch housing are removed or illustrated in phantom.
Figure 2A:
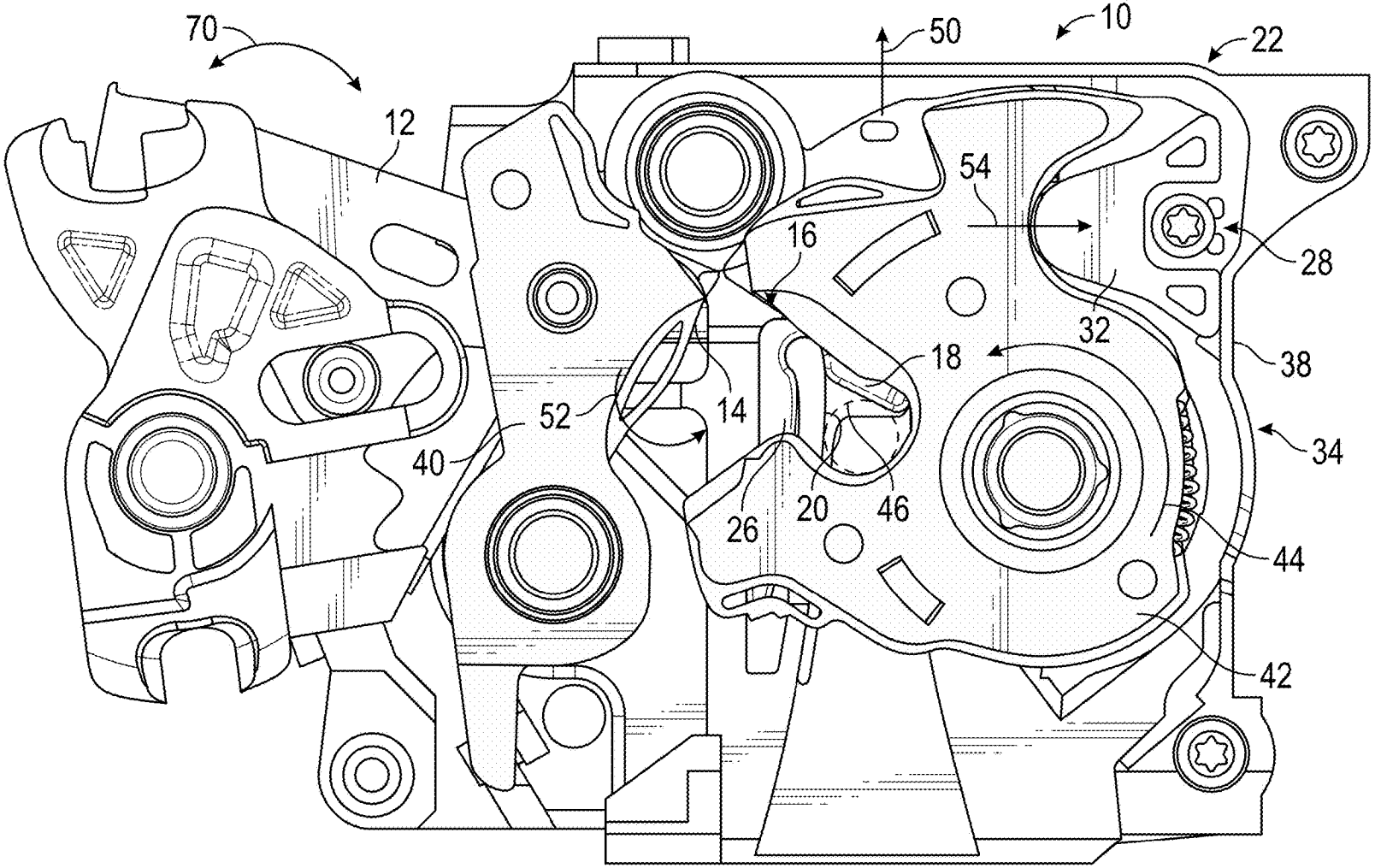
FIG. 2A is a top view of the latch housing wherein the intermittent lever is in the unlatched position and the fork bolt and the detent lever and portions of the latch housing are removed.
Figure 2B:
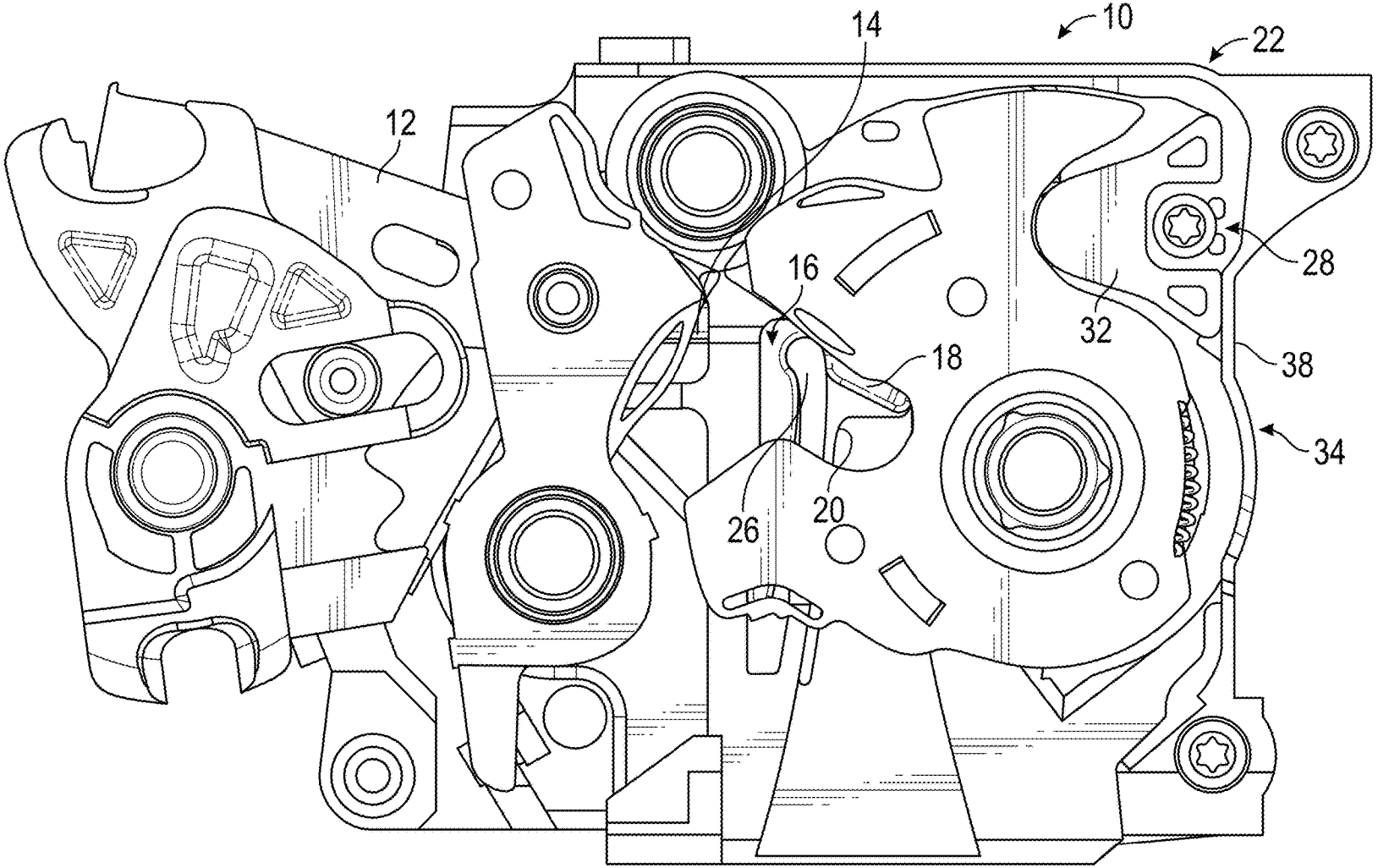
FIG. 2B is a top view of the latch housing wherein the intermittent lever is in the unlatched position and the fork bolt and the detent lever and a top or cover portion of the latch housing is not illustrated.
Figure 2C:
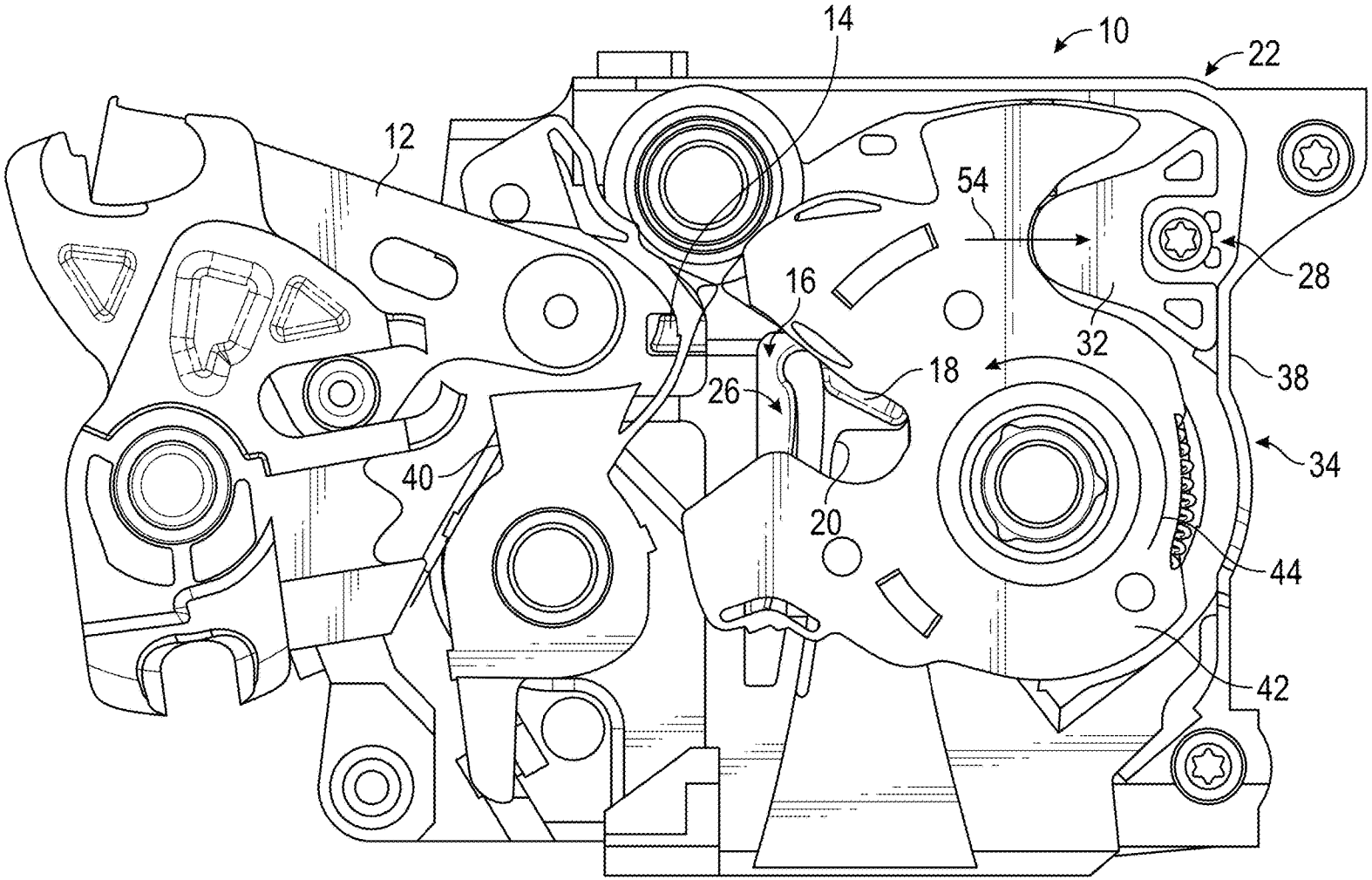
FIG. 2C is a top view of the latch housing wherein the intermittent lever is in the unlatched position and the fork bolt and the detent lever are illustrated is solid and a portion of the detent lever is cut away.
Figure 2D:
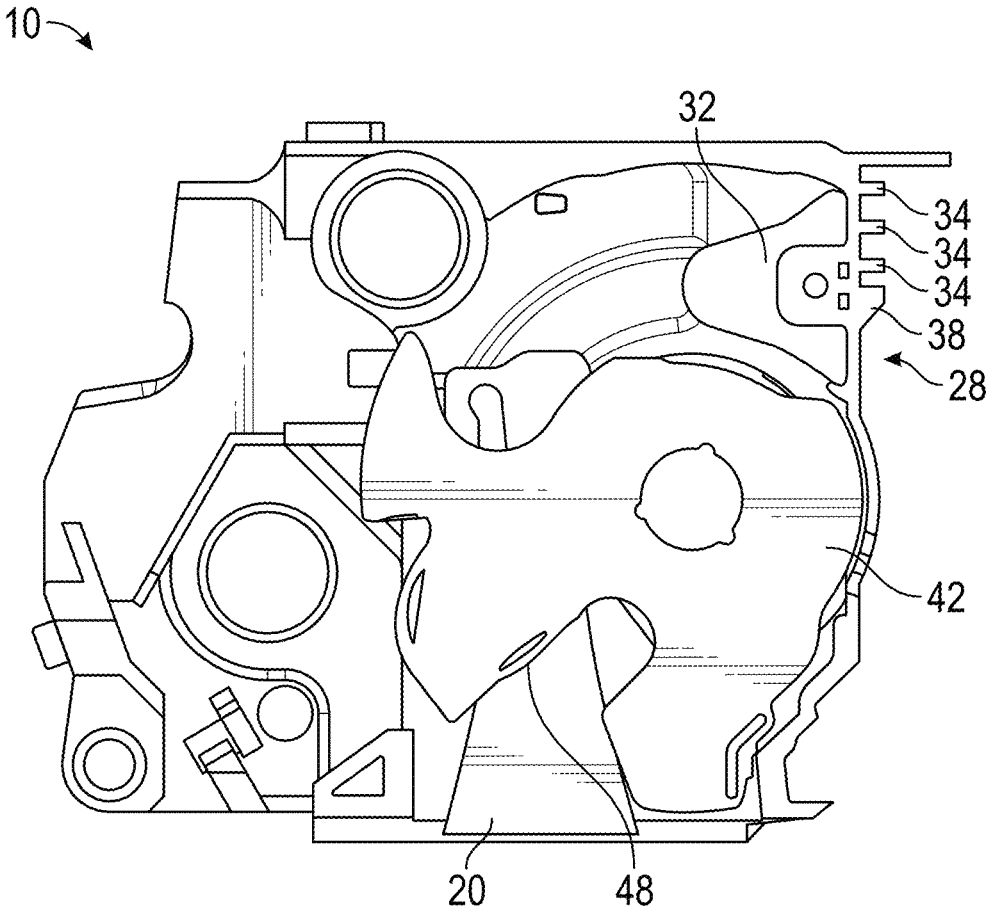
FIG. 2D is a view of the latch housing wherein the fork bolt is in the open position.
Figure 3:
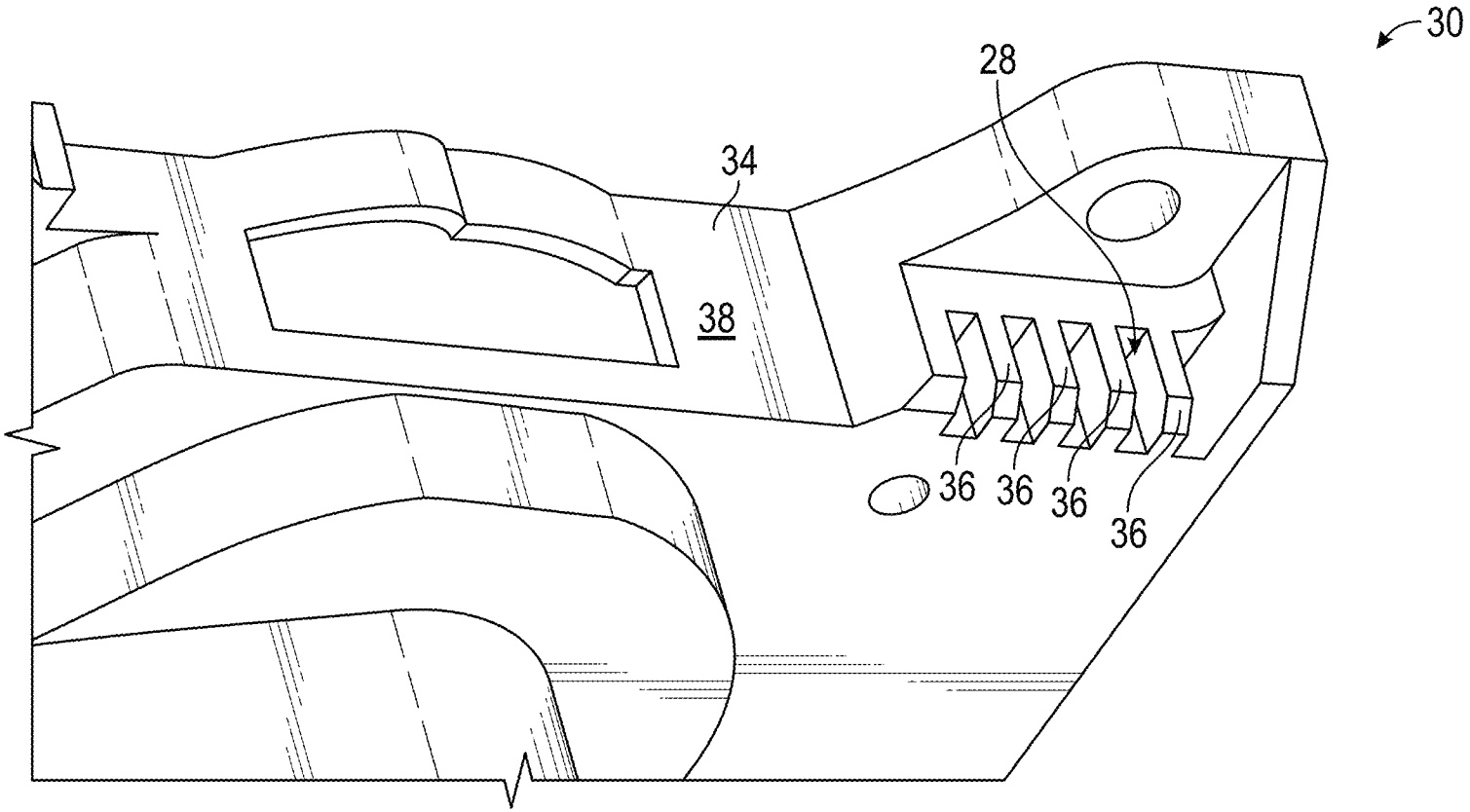
FIGS. 3 and 3A are a side perspective view the latch housing illustrating a strengthening feature according to an alternative embodiment.
Figure 3A:
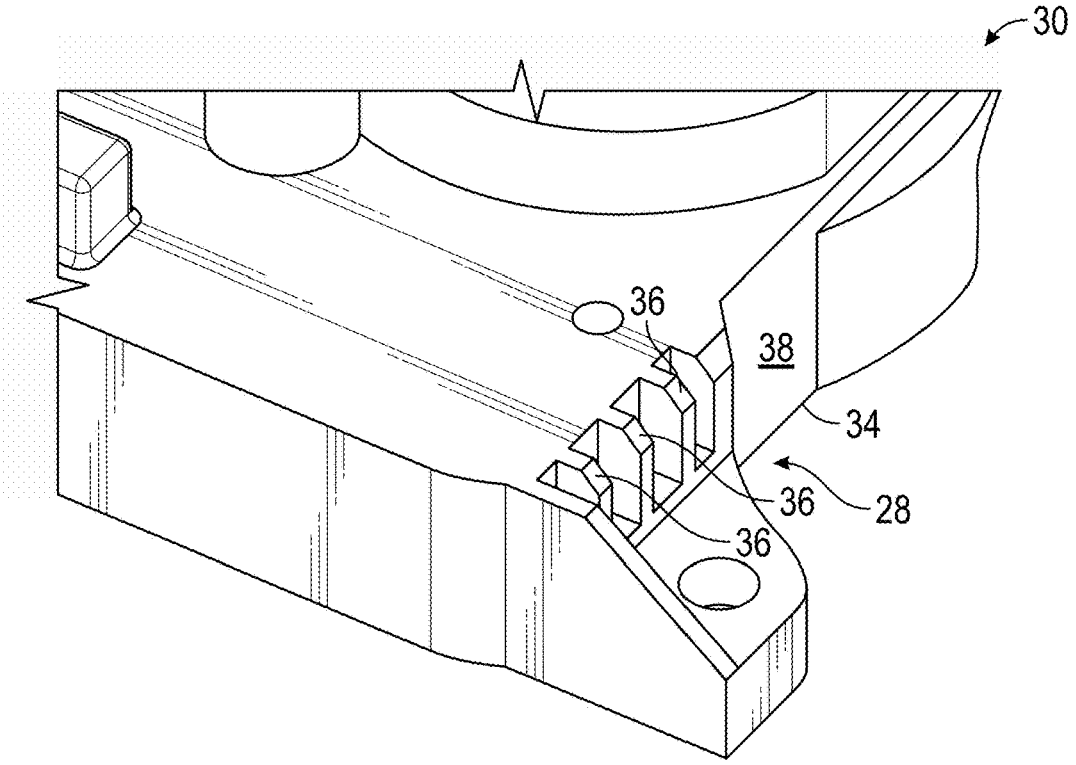

As illustrated in FIGS. 1 and 2, an intermittent lever 12 is pivotally secured to the latch 10 for movement about an axis 15 between a first or latched position (See FIGS. 1 and 1A) to a second or unlatched position (See FIGS. 2, 2A, 2B and 2C) in the direction of arrows 70. Movement of the intermittent lever 12 may be due to operation of an actuator (not shown) operatively coupled to the intermittent lever 12. The intermittent lever 12 is also operatively coupled to a detent lever or pawl 40 wherein movement of the intermittent lever 12 between the first or latched position to the second or unlatched position causes a corresponding movement of a detent lever or pawl between a first or engaged position and a second or disengaged position. The detent lever or pawl 40 is configured to cooperate with a fork bolt or claw 42 of the latch 10 as is known in the related arts. For example, movement of the detent lever 40 to the first or engaged position prevents the fork bolt or claw 42 from moving from a latched position (illustrated in at least FIGS. 1A, 2A, 2B and 2C) towards an open position (illustrated in FIG. 2D) in the direction of arrow 44. In addition, movement of the detent lever 40 to the second or disengaged position from the first or engaged position allows the fork bolt or claw 42 to move from the latched position (illustrated in at least FIGS. 1A, 2A, 2B and 2C) towards an open position (illustrated in FIG. 2D) in the direction of arrow 44.

Undesired noises may be generated by the intermittent ever 12 as it moves between the first or latched position to the second or unlatched position as in some designs the intermittent lever 12 may be allowed to move and resonate as the pawl or detent lever 42 stops abruptly against a rest bushing or other component of the latch 10.

In accordance with one non-limiting exemplary embodiment of the present invention a small elastomeric feature 14 is positioned to contact the intermittent lever 12 when it is in the first or latched position illustrated in at least FIGS. 1, 1A. Contact with the elastomeric feature 14 will dampen or mitigate undesirable noises when the latch is operating. In one embodiment, the elastomeric feature 14 is formed from a rubber or an elastomer (e.g., neoprene, urethane, nitrile, etc. or any other equivalent material that is capable of being formed or molded into the desired configurations).

In one embodiment, the elastomeric feature 14 is integrated into or integrally formed with a striker overslam bumper 16 that formed from any suitable material including but not limited to those mentioned above and has an integral portion 18 located in a throat 20 of a housing 22 of the latch 10 such that a striker 46 (illustrated by the dashed lines in FIG. 1A) contacts the portion 18 when it is inserted all the way into throat 20 until it contacts bumper 16. As is known in the related arts the striker 46 is received into the throat 20 as fork bolt 42 rotates from the open position in FIG. 2D in a direction opposite to arrow 44 and striker 46 is received within a throat 48 of the fork bolt 42.

Figure 4:
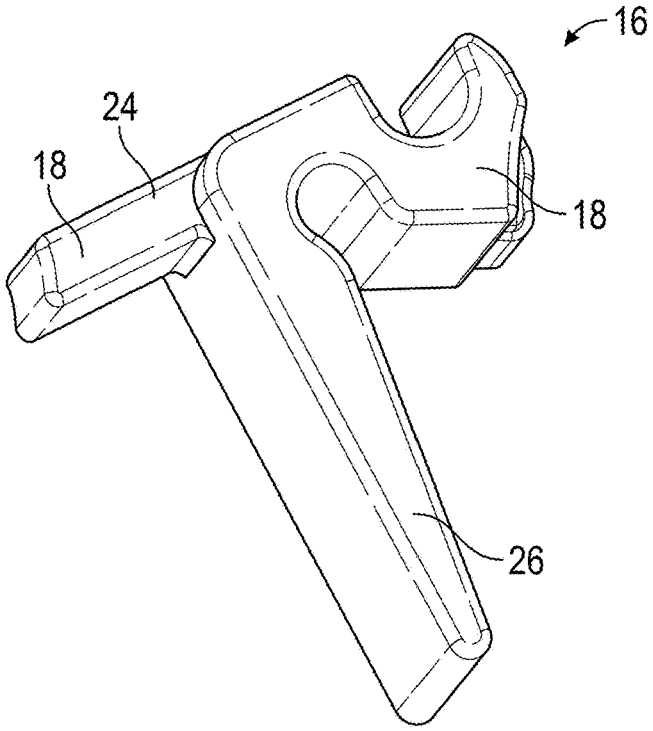
FIG. 4 is perspective view of the overslam bumper with the elastomeric feature configured to contact the intermittent lever.
Figure 5:
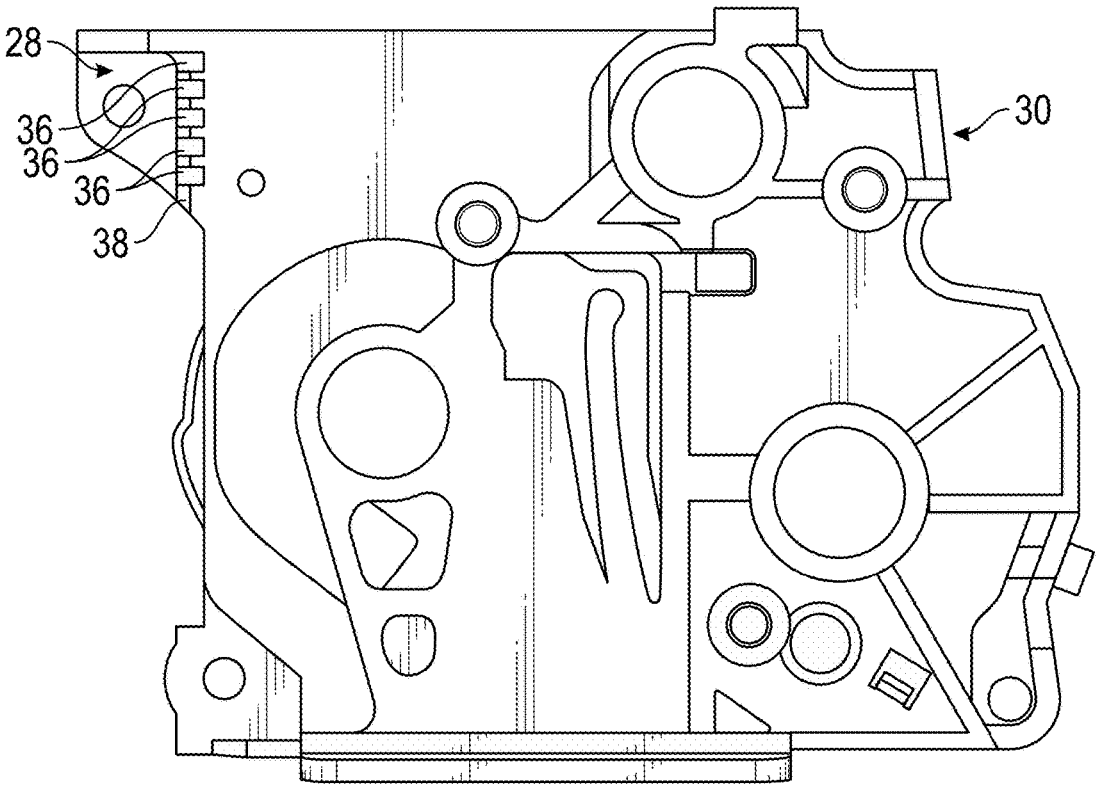
FIG. 5 is a bottom view of the latch housing.

In one embodiment, the portion 18 may be deflected inwardly in the direction of arrow 50 as the striker 46 is received within throat 20. During this movement, portion 26 may rotate in the direction of arrow 52. As shown in FIG. 4, portion 26 or portions of portion 26 of the bumper 16 may be located above and/or below feature 14 such as a different plane than the portion that comprises elastomeric feature 14. Of course, other configurations are contemplated to be within the scope of various embodiments of the present invention.

By integrating this elastomeric feature 14 into bumper 16 additional cost savings and optimal assembly time may be achieved. In other words and in some embodiments, a portion of the overslam bumper 16 is extended to provide the elastomeric feature 14 that a portion of the intermittent lever 12 contacts when it is in the latched position thereby enhancing the overall sound quality of the latch 10.

In some embodiments, the bumper 16 may have an integral portion 18 located in a throat 20 of the latch housing 22 and extending therefrom is a leg portion 24 that terminates at portion 14, which is configured and positioned to contact the intermittent lever 12 when it is in the latched position. In some embodiments, the bumper 16 also has another leg or portion 26 that extends from the bumper 16 in a different direction for use in other sound deadening or sound improvement applications.

Accordingly and as mentioned above and by integrating this elastomeric feature 14 into bumper 16 additional cost savings and optimal assembly time may be achieved. Still further, bumper 16 may have numerous configurations in order to achieve various sound deadening or sound improvement for various independently moving components of the latch 10.

In an alternative embodiment, which may be implemented either alone or in combination with the aforementioned elastomeric feature 14, a strengthening feature 28 is incorporated into housing 22 or a portion 30 of housing 22 (e.g., a housing having two or more portions secured together to form housing 22 when latch 10 is assembled). For example, the housing may comprise a lower housing portion and an upper housing portion.

In some assemblies, when a claw or fork bolt 42 of the latch 10 rotates or moves to a certain position such as a fully latched position or in some instances past the fully latched position, the housing or a portion thereof may be subject to a load due to contact either directly or indirectly with a portion of the fork bolt or claw 42. In some embodiments, this is due to the fork bolt or claw 42 contacting a bumper 32 located between a housing wall 34 and the moving or rotating fork bolt as it transitions through various stages of rotation or in particular to an overslam position wherein the fork bolt 42 rotates past a latched position due to the travel of the striker 46 in the direction of arrow 50. In one embodiment, the bumper 32 is formed from any suitable rubber or elastomer material including but not limited to those mentioned above and may be located on or adjacent to an interior surface of the housing in particular housing wall 34.

In order to accommodate for this load the structural integrity of the latch housing 22 is increased by locating a strengthening feature 28 proximate to the desired area of increased strength, which in one embodiment may be adjacent to bumper 32. In one embodiment, the strengthening feature 28 may be integrally formed or molded with housing 22 as it is formed during any suitable manufacturing process (e.g., injection molding, 3D printing and equivalents thereof).

In one embodiment, this strengthening feature may be provided by a plurality of ribs 36 located on an exterior surface 38 of a wall 34 of the latch housing 22 or a portion 30 thereof and on opposite side of the wall or interior surface that makes contact with or is adjacent to bumper 32. In one embodiment, the plurality of ribs 36 may be vertically arranged and may also contribute to localized increased wall thickness proximate to bumper 32. For example, ribs 36 may be vertically arranged and may be located to provide discrete areas of increased wall thickness adjacent to bumper 32.

The addition of vertical structural features and optimized wall thickness provides a latch housing geometry that can withstand forces applied to it in the direction of arrow 54 via the fork bolt or claw 42 and in particular if the fork bolt or claw 42 has rotated to an over travel position in a direction opposite to arrow 44. FIGS. 1A, 2A, 2B and 2C show a portion of the fork bolt 42 contacting the bumper 32.

In one embodiment and by optimizing the existing latch assembly or latch housing geometry, an improved latch and/or latch housing is provided. Moreover, this improved design is facilitated through no additional components as the strengthening feature is incorporated into the existing housing. Thereby saving piece cost as well as tooling costs. Still further and in one embodiment and by incorporating these features into the existing housing there is no requirement to change the tooling or fixtures required for the manufacture of the housing.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A vehicle door latch, comprising:

a housing, wherein the housing has a strengthening feature that increases a thickness of a portion of a wall of the housing such that the portion of the wall of the housing has a thickness greater than the rest of the wall, wherein the strengthening feature is a plurality of ribs that extend from an exterior surface of the wall;

an intermittent lever pivotally mounted to the housing for movement between a latched position and an unlatched position, wherein the intermittent lever is operatively coupled to a pawl of the latch, and wherein movement of the intermittent lever between the latched position and the unlatched position causes a corresponding movement of the pawl between an engaged position and a disengaged position and the pawl is configured to cooperate with a claw of the latch such that movement of the claw into the engaged position prevents the claw from moving from a latched position to an unlatched position;

an elastomeric feature configured to contact the intermittent lever when it is in the latched position, wherein the elastomeric feature is integrally formed with a bumper located in the housing and the bumper has another integral portion located in a throat of the housing;

wherein the pawl is pivotally mounted to the housing for rotation about an axis offset from an axis of rotation of the intermittent lever; and an elastomeric bumper positioned against an inside surface of the wall of the housing that the ribs extend from and wherein the elastomeric bumper is configured to receive an impact force from a fork bolt of the latch when the it reaches a fully latched position.

2. The latch as in claim 1, wherein the bumper has a leg portion extending therefrom that terminates at a distal end, wherein the distal end provides the elastomeric feature.

3. The latch as in claim 2, wherein the bumper has another leg that extends from the bumper in a different direction than the leg portion.

4. The latch as in claim 1, wherein the plurality of ribs are integrally molded into the housing and the housing is formed from plastic.

5. The latch as in claim 4, wherein the bumper as a leg portion extending therefrom that terminates at a distal end, wherein the distal end provides the elastomeric feature.

6. The latch as in claim 5, wherein the bumper has another leg that extends from the bumper in a different direction than the leg portion.

7. The latch as in claim 1, wherein the elastomeric feature does not contact the intermittent lever when the intermittent lever is in an unlatched position.

8. The latch as in claim 7, wherein the bumper has a leg portion extending therefrom that terminates at a distal end, wherein the distal end provides the elastomeric feature.

9. The latch as in claim 8, wherein the bumper has another leg that extends from the bumper in a different direction than the leg portion.

* * * * *